United States Patent [19]

Nemirofsky

[11] 4,120,053

[45] Oct. 17, 1978

[54] OBJECT-DISPENSING WEARING APPAREL

[76] Inventor: Frank R. Nemirofsky, 2837 Trotter Way, Walnut Creek, Calif. 94596

[21] Appl. No.: 854,300

[22] Filed: Nov. 23, 1977

[51] Int. Cl.[2] ..... A41B 1/00

[52] U.S. Cl. ..... 2/115

[58] Field of Search ..... 2/69, 77, 78 R, 94, 2/106, 113, 115, 108, 247, 250, 253, 243, 257; 221/64, 65

[56] References Cited

U.S. PATENT DOCUMENTS

| | | | |
|---|---|---|---|
| 3,320,620 | 2/1964 | Holzwarth et al. | 221/65 |
| 3,485,241 | 12/1969 | Polky | 2/114 |

FOREIGN PATENT DOCUMENTS

| | | | |
|---|---|---|---|
| 1,127,298 | 8/1956 | France | 221/64 |

*Primary Examiner*—Doris L. Troutman

*Attorney, Agent, or Firm*—Townsend and Townsend

[57] ABSTRACT

A portion of an article of clothing is provided with a sheet of material that is placed in confronting relation with and affixed to an inner surface of the portion to form a pocket for holding a number of novelty-type objects. An aperture is formed in an outer surface of the portion to communicate the outer surface to the pocket and to allow the objects contained therein to be dispensed therefrom. The outer surface is provided with an illustrative design that draws a viewer's attention to and suggests the aperture as a dispensing point for the objects.

10 Claims, 8 Drawing Figures

OBJECT-DISPENSING WEARING APPAREL

The present invention pertains to an article of clothing that allows the dispensing of novelty items or confections as gumballs and the like.

BACKGROUND AND SUMMARY OF THE INVENTION

Recently, the novelty industry has seen a substantial rise in articles of clothing that are provided with various illustrations or designs. For example, hats, T-shirts and even trousers are provided with likenesses of well-known personalities, illustrations derived from various popular motion pictures, school names and emblems, cute, witty phrases and advertising logos. In each case, the purpose and function are the same: to provide others with a view of a particular illustration or design, be it for the novelty (e.g., entertainment) purposes only, advertising, or both.

For the most part, however, such novelty garments are totally passive; that is, they merely present a design illustration that is to be viewed. There is no specific interplay between the viewer, the article of clothing and/or the wearer unless the illustration requires the one viewing to perform some deciphering function.

The present invention, therefore, has as a primary object the use of clothing as an item of entertainment, novelty or advertisement. The invention includes forming a pocket on an inner surface of a portion of an article of clothing. The pocket so formed is adapted to contain such novelty items as plastic footballs, confections and the like. A dispensing aperture is formed in the portion to communicate the outer surface of the portion to the pocket and thereby allow ingress and egress of the contents of the pocket. The size and shape of the dispensing aperture is determined by the objects to be dispensed therefrom so that only one object at a time will be dispensed from the pocket via the aperture. The outer surface of the portion is provided with an illustrative design fashioned in such a way so as to suggest to a viewer the aperture as a point from which whatever is contained in the pocket may be dispensed.

One embodiment of the invention contemplates the use of a T-shirt as the article of clothing. A sheet of material is affixed to the inner surface of the chest or front portion of the T-shirt to define a pocket.

Imprinted on the outer surface of the T-shirt is a likeness or illustration of a conventional gumball machine (e.g., a machine of the type having a glass jar-like container for gumballs sitting on a bottom section which functions to accept coins and dispense the gumballs). The pocket and gumball machine illustration are relatively positioned in generally registered relation. A small slit in the T-shirt forms the dispensing aperture which is positioned to provide communication to the pocket for egress of whatever the pocket contains from the pocket. The aperture is also positioned relative to the machine illustration so that the aperture is incorporated into the design features — in this case, the dispensing trough or chute of the machine representation. Since the illustration imprinted on the garment in this embodiment of the invention is a gumball machine, it stands to reason that gumballs will be contained within the pocket and dispensed (via appropriate manipulation through the T-shirt) through the dispensing aperture.

If desired, an additional pocket may be formed in the same manner as described above. A second slit is formed in and positioned relative to the additional pocket for communication thereto. The slit thereby forms a coin-receiving aperture which provides ingress for coins to the second pocket which holds the coins. Preferably, the coin-receiving aperture and pocket are situated with respect to any coin-accepting mechanism representation of the gumball machine illustration to present some modicum of integrity in the particulars of the machine so illustrated.

A number of advantages are achieved by the present invention disclosed. First, as a novelty item, a confection-dispensing garment provides a novel form of interaction between the viewer and wearer not heretofore realized. Not only is the invention to be viewed but it may be utilized to actually dispense confections or the like to the entertainment and delight of the viewer.

Further, it should be evident that the invention is uniquely adapted as a medium of advertising. A manufacturer of certain confections can advertise his products by allowing them to be dispensed through various garments constructed in accordance with the teachings of the present invention, including appropriate illustrations or designs. The design possibilities are limited only by the designer's imagination.

Finally, particular embodiments can be used as teaching devices for children. For example, the present invention can be manufactured in a form which not only dispenses certain objects but accepts and holds coins. Children can use the garment so constructed to obtain a sense of business-like appreciation for selling items and the value put on the sales.

For a fuller understanding of the nature and advantages of the invention, reference should be had to the ensuing detailed description taken in conjunction with the accompanying drawings.

DETAILED DESCRIPTION OF THE INVENTION

Figure 1:
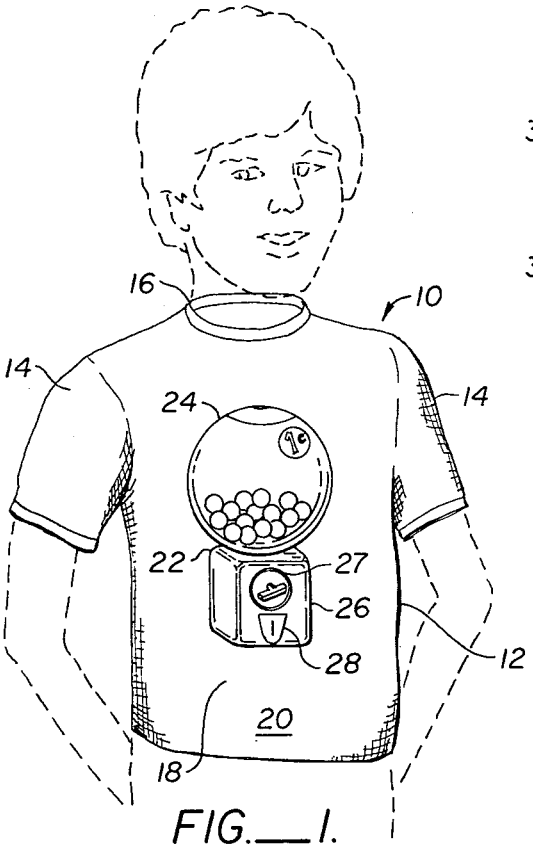
FIG. 1 illustrates by perspective view an embodiment of the present invention in the form of a T-shirt.
Figure 2:
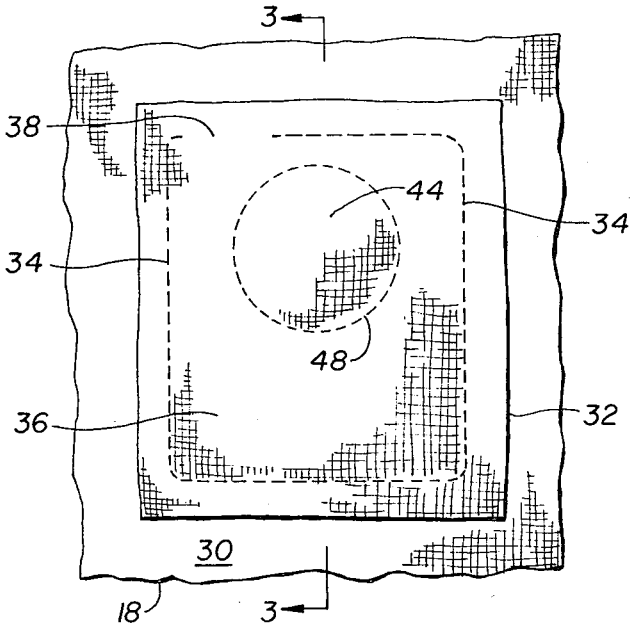
FIG. 2 is a plan view of the rear surface of the front or chest portion of the T-shirt, illustrating the formation of a confection-containing pocket and a coin-containing pocket.
Figure 3:
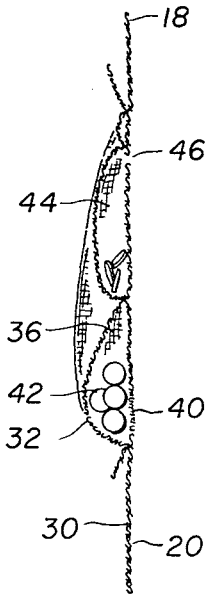
FIG. 3 is a fragmentary cross-sectional view of the present invention further illustrating the formation of the coin-containing and confection-containing pockets.

Turning now to the Figures, there is shown an article of clothing embodying the concepts of the present invention. For purposes of the following description, the article of clothing is shown in the form of T-shirt 10. However, as will be evident, the invention can be embodied in any type of garment. As the Figures illustrate, T-shirt 10 is of conventional design and, therefore, includes a torso section 12, shortened sleeves 14 extending from the shoulders of the torso section, and a hemmed neck opening 16.

The torso section 12 of T-shirt 10 includes a front portion 18, the outer surface 20 of which has imprinted thereon a representation 22 of a conventional coin-operated gumball machine. The gumball machine representation 22 is shown as having a spherically shaped gumball-containing enclosure 24 that sits upon dispensing unit 26. Note that the dispensing unit of the representation 22 also has indicia representative of a coin-receiving slot 27 and gum-dispensing orifice 28.

Affixed to the rear surface 30 of front portion 18 is a sheet of material 32. It is only the peripheral portion of material 32 that is affixed to the rear surface, as for example, by stitching 34, forming pocket 36. A section 38 of the outer periphery of material 32 preferably is left unstitched to permit the ingress of whatever is to be placed and carried by the pocket 36.

A dispensing aperture 40 is formed in the chest portion 18 to communicate the outer surface 20 to the pocket 36 and to allow egress for whatever pocket 36 contains. In particular, it should be noted that dispensing aperture 40 is situated relative to the gumball machine representation 22 so that it forms a part of and is embodied within the representation's gum-dispensing orifice 28. The dispensing aperture can be formed merely by cutting a slit in the T-shirt 10 material. However, a neater appearance is achieved if the dispensing aperture is reinforced with buttonhole-type stitching 41 or similar reinforcement. Stitching 41 also serves to hold the aperture in a somewhat closed condition.

The size and shape of dispensing aperture 40 is determined by whatever is to be contained by and dispensed from (via the dispensing aperture) pocket 36. Here, for example, pocket 36 is provided with a number of conventional sphere-like gumballs 42, which can be placed in the pocket via the open section 38. Preferably, gumballs 42 are to be dispensed through the dispensing aperture one at a time. Thus, if the dispensing aperture is too large, the gumballs could exit the pocket two or more at a time or merely fall out. Alternately, if dispensing aperture 40 is too small, gumballs will be dispensed only if the aperture is stretched or torn.

Since the representation of this embodiment of the invention so permits, and if desired, a pseudo coin-accepting feature can be added. In this respect, therefore, a coin pocket 44 and a coin-receiving aperture 46 are formed. As with dispensing aperture 40, the coin-receiving aperture 46 is worked into the representation 22 by positioning aperture 46 so that it forms a part of the coin-receiving slot 27 of the gumball machine representation. Moreover, since the sheet of material 32 has a surface area that extends beyond the coin-receiving aperture 27, pocket 44 is conveniently formed by further joining the sheet of material 32 to the rear surface 30 of the T-shirt along a line 48 of affixation. The line 48 of affixation illustrated here forms a closed loop so that coins received and held by the coin-receiving pocket 46 would have to be removed therefrom the same way they entered — through coin-receiving aperture 46. Alternately, of course, pocket 44 can be formed with an access (not shown) opening provided similar to the opening provided gumball pocket 36 by unstitched section 38.

T-shirt 10 may be fabricated from any material but is typically fabricated from 100% cotton. To minimize shrinkage of the pocket, however, it is presently contemplated that the sheet of material 32 will be fabricated from a fabric that resists shrinkage, such as nylon or the like.

There are a number of methods or processes presently available for printing or otherwise affixing representations and the like on fabrics. One such method is the conventional and known lithograph heat transfer process of the "litho transfer", as it is known in the art. This process utilizes special papers and inks for transferring previously prepared designs from one medium to another when heat (typically in the neighborhood of 350° F.) is applied.

There are also a number of ways for joining the sheet of material 32 to the rear surface 30 of the T-shirt, such as, for example, by sewing or stitching. There are also available a number of adhesives, some of which are heat-activatable. In light of the availability of the "litho transfer" process referred to above and its utilization of heat, a heat-activatable adhesive is of particular advantage. For example, affixation of the representation (using the "litho transfer" process) and formation of the pockets (by attaching the sheet of material 32 using a heat-activatable adhesive) to be made concurrently, quickly and easily. An adhesive suitable for these purposes is a thermoplastic adhesive film sold by 3M Company under the trademark "Scotch-Weld" and more particularly in product specification 4060 (dated Sept. 15, 1971, revised Dec. 1, 1975).

Thus, the adhesive film may be temporarily attached to pre-cut sheets of material 32. The "litho transfer"-bearing representation 22 is placed on one surface of a garment fabric and the sheet of the material placed on an opposing surface in relative registry with the representation. If a dispensing (and coin-receiving) aperture is already formed in the fabric, proper registry of the representation and sheet of material is made relative to the aperture(s). Alternately, the aperture can be formed after the representation and sheet of material are affixed to the fabric.

Once registry is established, heat is applied to effect transfer of the representation and affixation of the sheet of material.

In use, pocket 36 is provided with a number of gumballs 41. The gumballs are placed in the pocket via the open section 38 or, if desired, through dispensing aperture 40. The T-shirt 10 is worn in the conventional manner, as illustrated in FIG. 1. As noted above, the force of gravity will tend to urge the gumballs into proximate relation with the dispensing aperture 40. The gumballs 41 are dispensed, either by the wearer of the T-shirt 10 or a viewer, by merely manipulating a gumball to the dispensing aperture and squeezing the gumball through the aperture. At the same time one or more coins 49 (if at all) are inserted through the coin-receiving aperture 46 and into the coin pocket 44.

Figure 5:
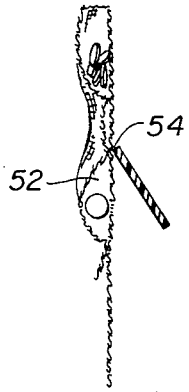
FIG. 5 is a fragmentary cross-sectional view of an alternate embodiment of the present invention illustrating attachment of a flap to cover the dispensing aperture.
Figure 4:
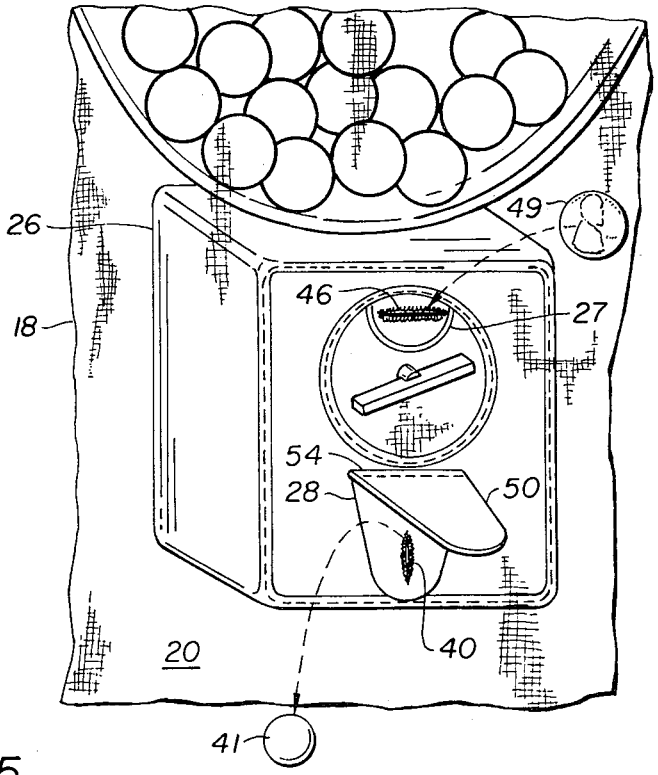
FIG. 4 is a partial plan view of the present invention showing its use in accepting coins and dispensing confections and illustrating the use of a flap to cover the dispensing apparatus, if desired.

FIGS. 4 and 5 illustrate a modification of this embodiment of the present invention. As illustrated, a flap 50 of fabric or plastic material is affixed to the outer surface 20 of T-shirt 10. The flap is positioned to cover dispensing aperture 40 and simulates a lid or door, sometimes used on dispensing troughs of conventional gumball machines - thereby increasing the impression of reality of the representation and, in turn, amplifying the overall novelty of this embodiment of the present invention.

One further feature should be noted with reference to FIGS. 4 and 5. Flap 50 is affixed to T-shirt 10 so that a lateral passage 52 is formed as by a line of stitching 54. Care should be taken, however, when so attaching flap 50 that the passage 52 so formed is large enough to accept communication of gumballs (or whatever is meant to be contained in pocket 36) to dispensing aperture 40. Note that passage 52 will tend to line up the gumballs 41 in proximity with the dispensing aperture - further aiding sequential egress of the gumballs via the dispensing aperture.

Figure 6:
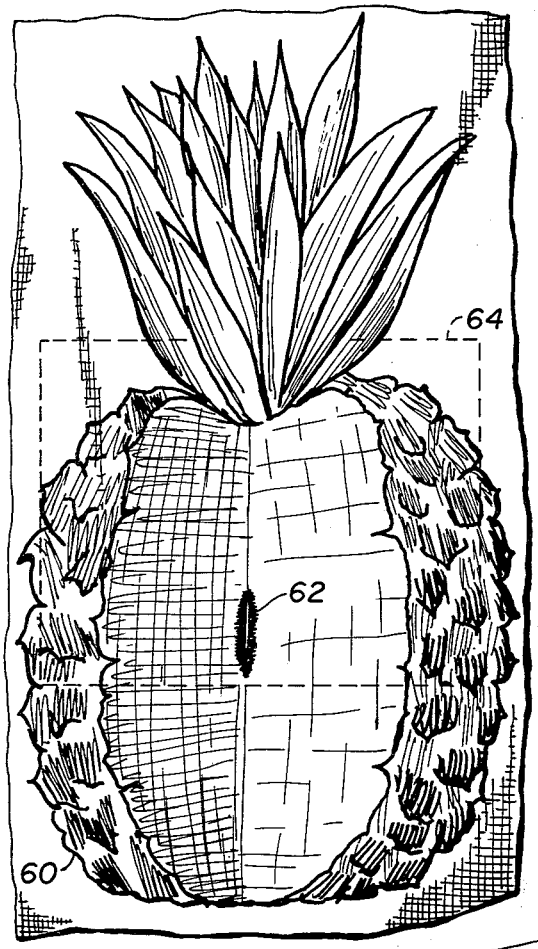
FIGS. 6–8 are further embodiments of the present invention, demonstrating the use of various other representations that may be used.
Figure 7:
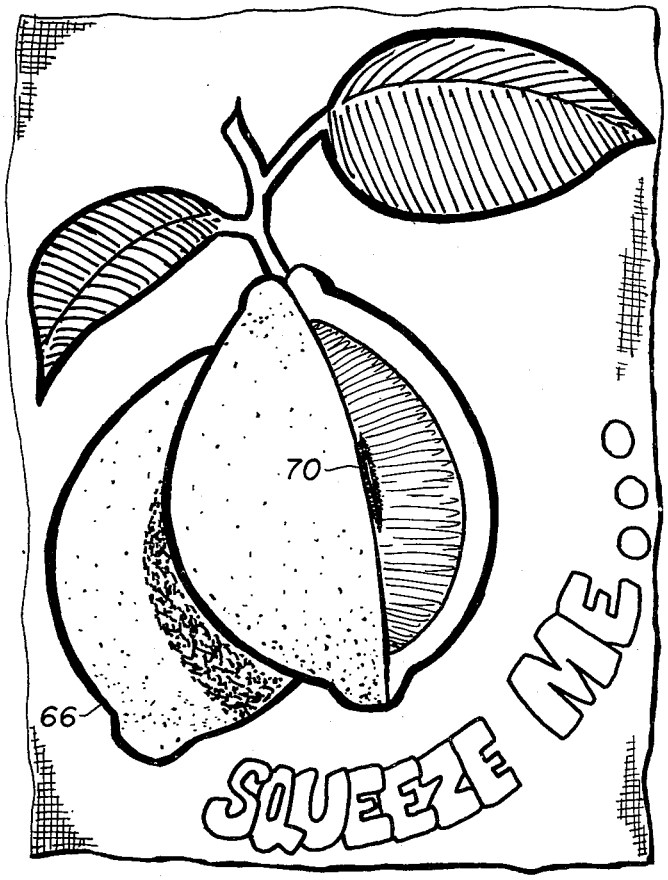
Figure 8:
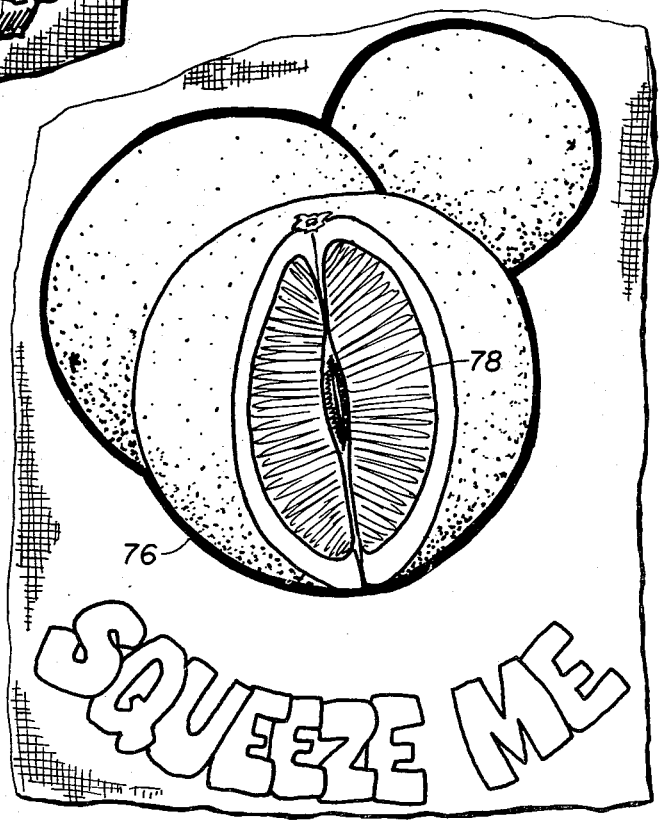

FIGS. 6–8 are alternate embodiments of the present invention. Thus, as FIG. 6 illustrates, the gumball machine representation 22 is replaced by pineapple representation 60. Dispensing aperture 62 is located generally in the center of the representation 60. Location of the dispensing aperture 60 relative to pocket 36 (illustrated by phantom line 64) formed therebehind is taken into consideration, as described above. That is, the relative locations of the dispensing aperture and pocket should be such that the force of gravity will typically urge the contents of the pocket into proximity with the dispensing aperture, when the garmet embodying the invention is worn. Thus, aperture 62 is placed in juxtaposed relation to the line of affixation 64 as illustrated.

One further feature of the present invention can now be noted. The particular representation used can suggest what is likely to be dispensed by the garment bearing the representation. Thus, a gumball machine representation suggests to a viewer that the objects dispensed via aperture 40 would be gumballs 41. Similarly, indicia 60, being representative of a pineapple, would suggest the possibility of dispensing pineapple-flavored confections (not shown).

In the same fashion, the lemon pair representation 66 of FIG. 6 suggests to a viewer that lemon-flavored confections, such as lemon drops (not shown), would be dispensed from aperture 70; while the oranges representation 76 of FIG. 8 suggests that orange-flavored confections (not shown) may be obtained via dispensing aperture 78. Thus, it can be seen that the particular type of representation to suggest whatever objects are to be dispensed is limited only by the imagination of those who seek to use the teachings of the present invention.

While the above provides a full and complete disclosure of the preferred embodiments of the invention, various modifications, alternate constructions and equivalents may be employed without departing from the true spirit and scope of the invention. For example, while the invention has been discussed with respect to the dispensing confections, there is no reason why the invention cannot be applicable for use in dispensing non-edible, novelty items. Thus, the indicia used on the outer surface of the garment worn by the user could be a representation of a football player in the process of throwing a forward pass. The aperture (and pocket associated therewith) could be positioned to dispense small plastic footballs from the representation's passing hand.

Therefore, the above description and illustrations should not be construed as limiting the scope of the invention which is defined by the appended claims.

What is claimed is:

1. A garment for dispensing novelty items of a predetermined size and shape, the garment comprising:

an article of clothing adapted to be worn by a person, the article including a portion having an outer surface, an inner surface, and an aperture formed thereon to communicate the outer surface to the inner surface, the aperture being dimensioned and configured relative to the size and shape of individual ones of the novelty items to allow only one novelty item to pass therethrough at a time;

indicia affixed to the outer surface suggesting the aperture as a point from which the novelty items may be received; and a pocket formed by a sheet of flexible material disposed in confronting relation to the inner surface, the material having an outer periphery that is positioned in generally surrounding relation to the aperture and attached to the inner surface, the pocket being adapted to hold a plurality of the novelty items in general proximate position with the aperture.

2. The garment of claim 1, wherein the piece of material is shrink-resistant.

3. The garment of claim 1, wherein the piece of material is fabricated from nylon.

4. The garment of claim 1, including means affixed to the inner surface of the portion for forming a second pocket, the portion including a second aperture to communicate the outer surface to the second pocket, the second aperture being dimensioned to receive coins.

5. The garment of claim 4, wherein the indicia is in the form of a gumball machine.

6. The garment of claim 1, wherein a portion of the outer periphery is left unattached to the inner surface of the article of clothing to allow ingress of the novelty items to the pocket.

7. In an article of clothing adapted to be worn by a person and having a portion defining an outer surface and an inner surface:

a pocket for containing a number of similarly shaped and dimensioned novelty items, the pocket being formed from a sheet of flexible, cloth-like material that is positioned in confronting relation with the inner surface of the portion and has an outer periphery that is affixed to the inner surface of the portion, the portion having an aperture formed therein to communicate the outer surface to the pocket, the aperture being relatively positioned to be proximate with the novelty items contained within the pocket when the article of clothing is worn by a person and dimensioned to pass therethrough individual ones of the novelty items in sequential fashion; and indicium affixed to the outer surface of the portion, the indicium generally suggesting the aperture as a point of egress for the novelty items.

8. The article of clothing of claim 7, wherein the article of clothing is a T-shirt; and wherein the portion is the front torso of the T-shirt.

9. The article of clothing of claim 8, wherein the indicia is in the form of a representation of a gumball machine.

10. The article of clothing of claim 7, wherein the sheet of material is fabricated from a shrink-resistant fabric.

* * * * *